US006482016B1

(12) United States Patent
McHugh et al.

(10) Patent No.: US 6,482,016 B1
(45) Date of Patent: Nov. 19, 2002

(54) POWER CONNECTOR

(75) Inventors: Robert G. McHugh, Golden, CO (US); Chang Chi Liu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,664

(22) Filed: Dec. 26, 2001

(51) Int. Cl.[7] ..... H01R 12/20
(52) U.S. Cl. ..... 439/79; 439/101
(58) Field of Search ..... 439/79, 101, 108

(56) References Cited

U.S. PATENT DOCUMENTS 6,129,564 A * 10/2000 Kawamae et al. ..... 439/79
6,290,514 B1 * 9/2001 McHugh et al. ..... 439/108
6,305,946 B1 * 10/2001 McHugh et al. ..... 439/60

* cited by examiner

*Primary Examiner*—Gary Paumen
(74) *Attorney, Agent, or Firm*—Wei Te Chung

(57) ABSTRACT

A power connector directly connects a central processing unit module to a power supply. The power connector includes a single insulation member retaining two rows of contacts that oppose each other defining a nip area therebetween to receive and retain a circuit board of the central processing unit module. The contacts of the upper one of the two rows are power contacts that transmit power to a central processing unit while the contacts of the lower one of the two rows are grounding contacts. An additional row of contacts is retained in the insulation member and located above the row of the power contacts. The contacts of the additional row extend over the power contacts and are configured to engage the circuit board. Some of the contacts of the additional row are cache power contacts that supply power to a cache memory of the central processing unit module, while the others of the contacts are signal contacts for transmitting I/O signals. The cache power contacts are arranged more close to each other than the signal contacts do. Thus contacts of different pitches and different purposes are integrated and retained in a single insulation member.

1 Claim, 5 Drawing Sheets

POWER CONNECTOR

BACKGROUND OF THE INVENTION

1. Field of the Invention

The present invention generally relates to the field of electrical connectors, and more particular to a power connector for direct connection between a CPU (Central Processing Unit) module and a power supply.

2. The Related Arts

The development of central processing units (CPUs) employed in computers or computer-based electronic devices brings the CPUs to a high efficient but high power consuming signal processing device. Such a high power consuming device requires a direct supply of electrical power in order to maintain proper operation. Power connectors that connect a CPU module to a power supply directly are available, such as U.S. Pat. No. 6,290,514 having the same assignee as the invention. The '514 patent discloses a power connector comprising a number of separately-made insulation members. Conductive contacts for different purposes and of different sizes and shapes are respectively mounted to the insulation members. The insulation members with the contacts thereon are then fixed together. Hence, such a conventional power connector suffers high costs caused by its complicated structure and manufacture.

U.S. Pat. No. 6,305,946 having the same assignee as the invention, is another example of directly connecting a CPU module to a power supply. The '946 patent discloses a power connector having a number of rows of conductive contacts retained in a housing. The contacts are arranged with identical pitch.

Both patents are assigned to the assignee of the present invention and are cited here for reference.

SUMMARY OF THE INVENTION

An object of the present invention is to provide a power connector having a simple structure and thus low costs.

Another object of the present invention is to provide an electrical connector comprising a single housing retaining a number of rows of conductive contacts of different pitches.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
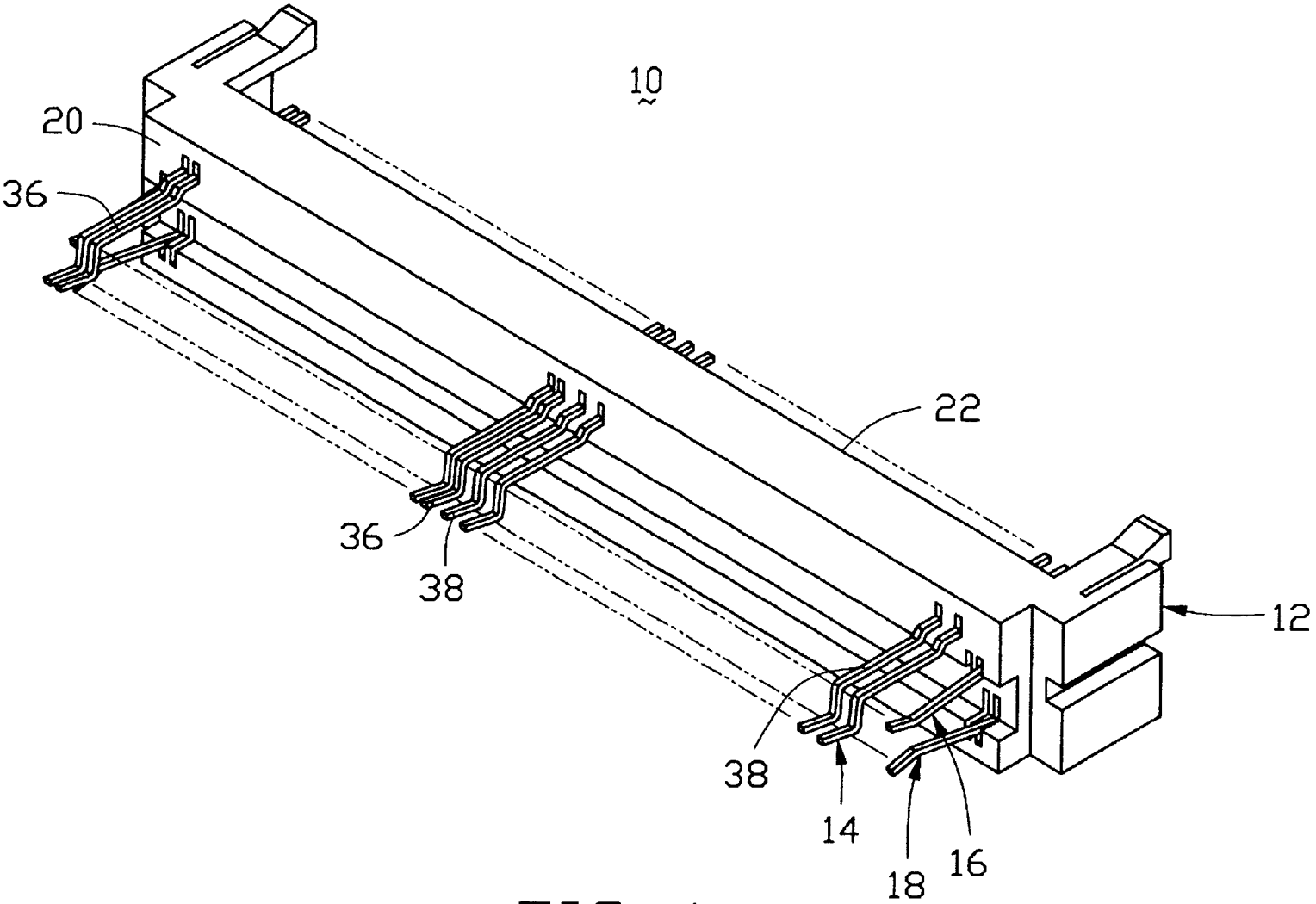
FIG. 1 is a perspective view of a power connector constructed in accordance with the present invention.
Figure 2:
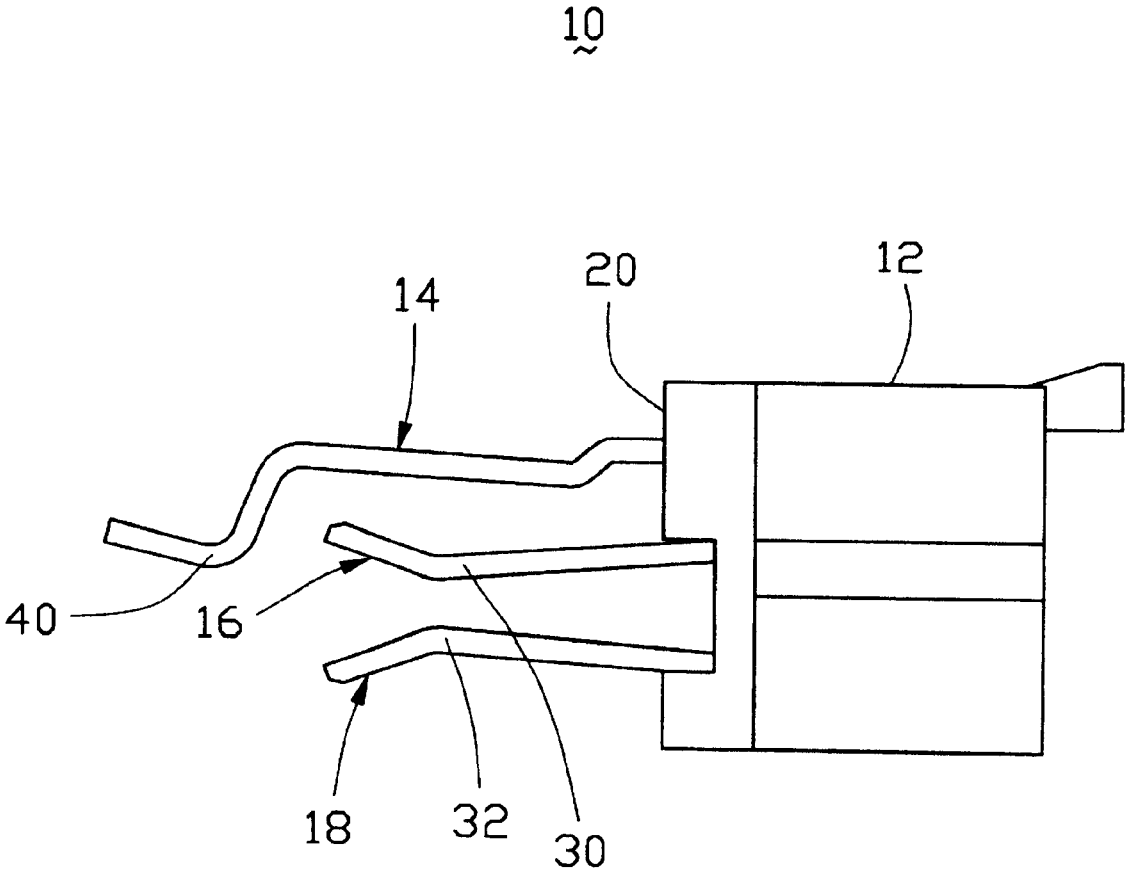
FIG. 2 is a side elevational view of the power connector of the present invention.

With reference to the drawings and in particular to FIGS. 1 and 2, a power connector constructed in accordance with the present invention, generally designated with reference numeral 10, comprises an elongate housing 12 made of a single piece of insulation material and contacts that are retained in the housing 12 in first, second and third rows 14, 16, 18. The contacts of the three rows 14, 16, 18 extend beyond front and rear faces 20, 22 of the housing 12 for electrically engaging a circuit board 24 of a CPU (Central Processing Unit) module in a front side of the housing 12 and a capacitor board 26 and a flexible circuit board 28 (FIG. 5) that partly constitute a power supply (not shown) in a rear side of the housing 12.

Figure 4:
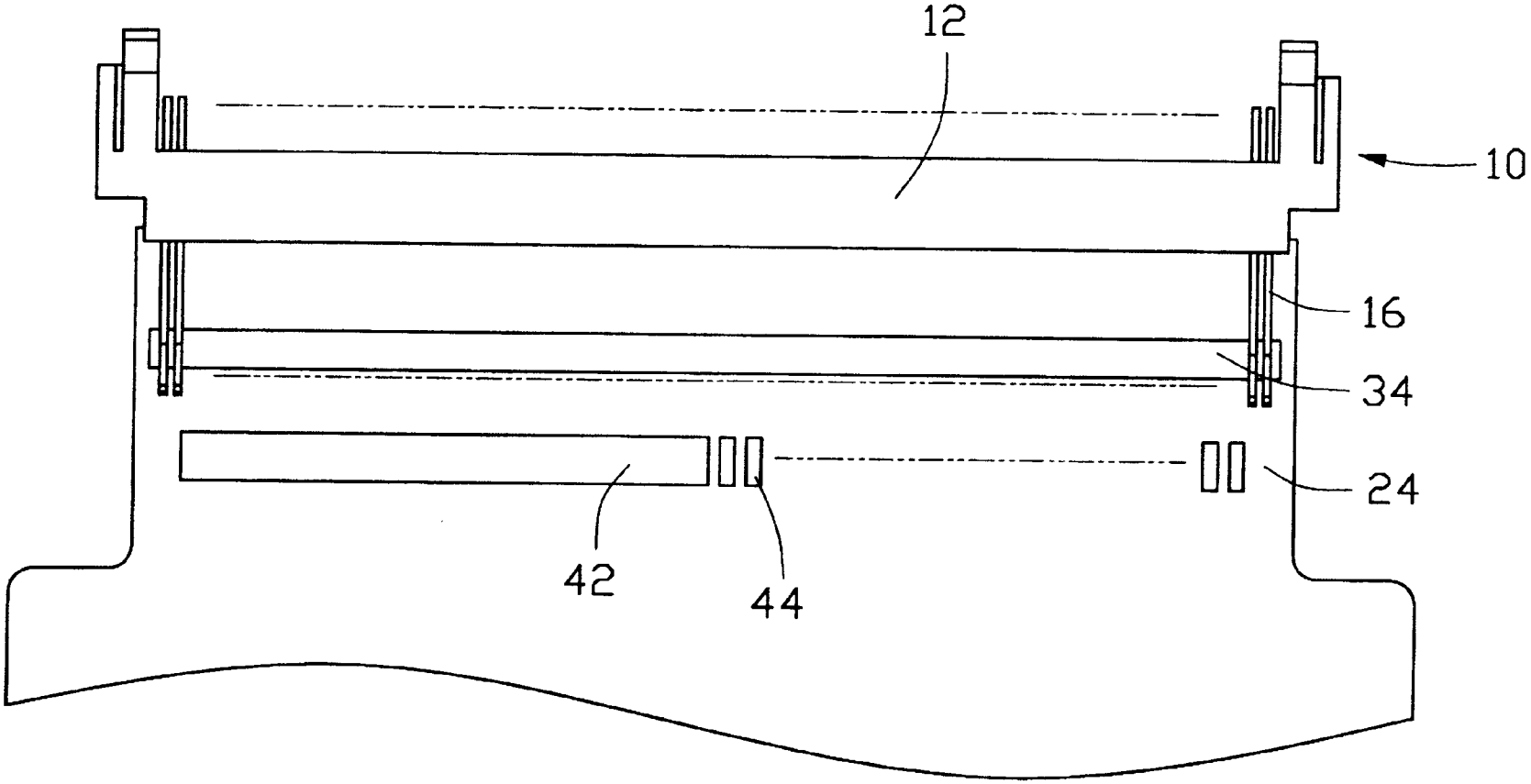
FIG. 4 is similar to FIG. 3 with the first row of contacts removed while the contacts of the second and third rows left, a circuit board being additionally shown for illustration.

Also referring to FIG. 4, the contacts of the second and third rows 16, 18 are in general identical and are arranged as mirror image. To simplify the description, the contacts of the second row 16 and the third row 18 will also be referred to as second contacts and third contacts and also designated with the reference numerals 16, 18. Each second contact 16 and the corresponding third contact 18 form a pair for engaging and retaining the circuit board 24 therebetween. In this respect, each second and third contact 16, 18 has a concave portion 30, 32 opposing each other and thus forming a nip area (not labeled) therebetween. The circuit board 24 is forced into the nip area with deflection of the second and third contacts 16, 18. The reaction force of the contacts 16, 18 securely retains the circuit board 24. Conductive pads 34 are formed on opposite surfaces of the circuit board 24 for electrically engaging the concave portions 30, 32 of the second and third contacts 16, 18. Mechanical and electrical engagement between the circuit board 24 and the second and third contacts 16, 18 are thus achieved.

In the embodiment illustrated, the second contacts 16 transmit power to the circuit board 24 for powering a central processing unit (not shown) of the circuit board 24, while the third contacts 18 are grounding contacts.

Figure 3:
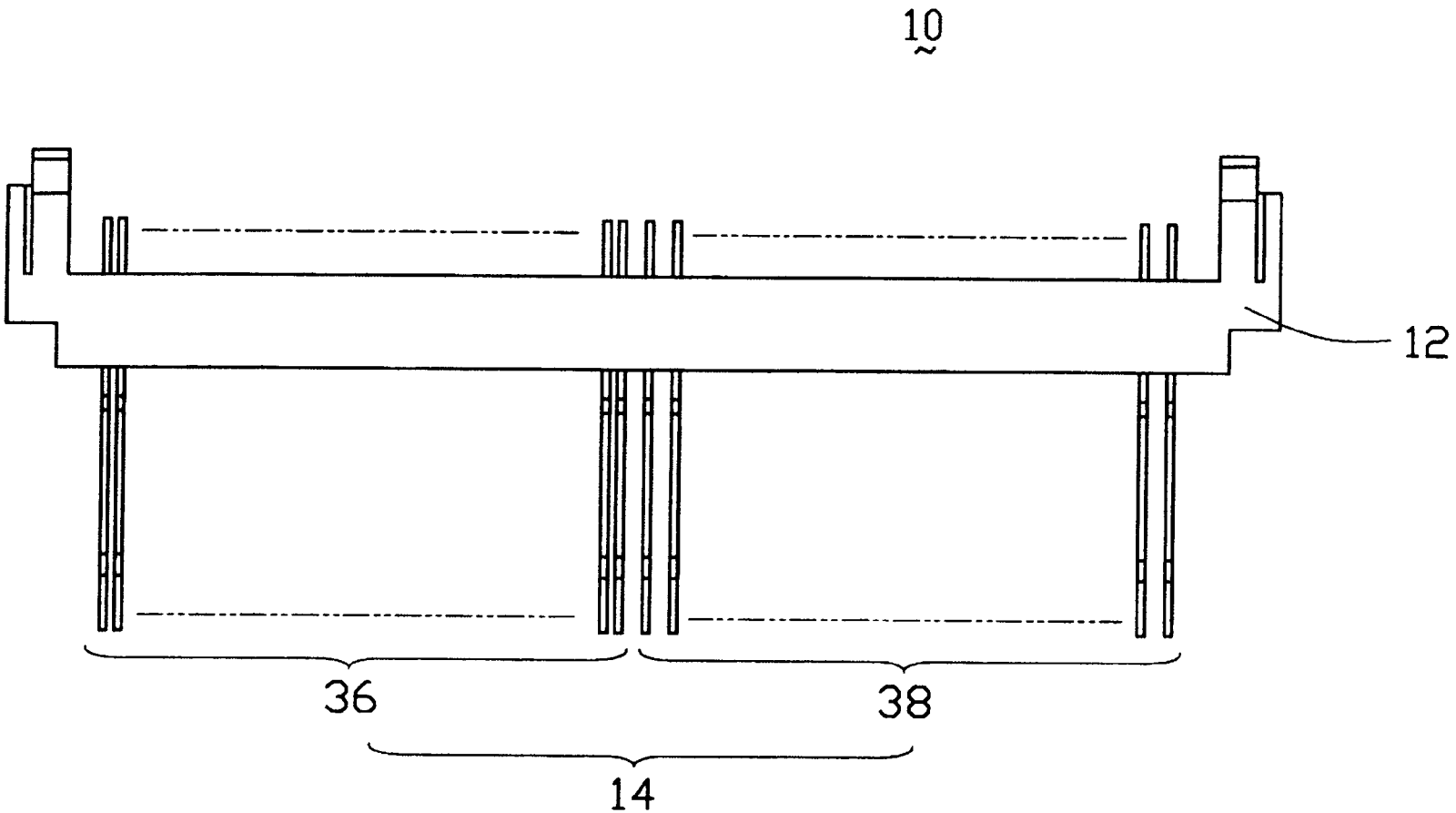
FIG. 3 is a top plan view of the power connector with a first row contacts left and second and third rows of contacts removed.

Also referring to FIG. 3, the contacts of the first row 14 is divided into a first group consisting of cache power contacts 36 and a second group consisting of signal contacts 38. The cache power contacts 36 transmit power to a cache memory (not shown) of CPU module. The signal contacts 38 transmit I/O signals to the CPU module of the circuit board 24. Since a large power consumption may be required by the cache memory, the cache power contacts 36 are arranged as close to each other as possible to increase the number of the contacts 36 in a give space and thus reducing resistance induced thereby. Thus, the cache power contacts 36 have a small pitch as compared to that of the I/O signal contacts 38.

Figure 5:
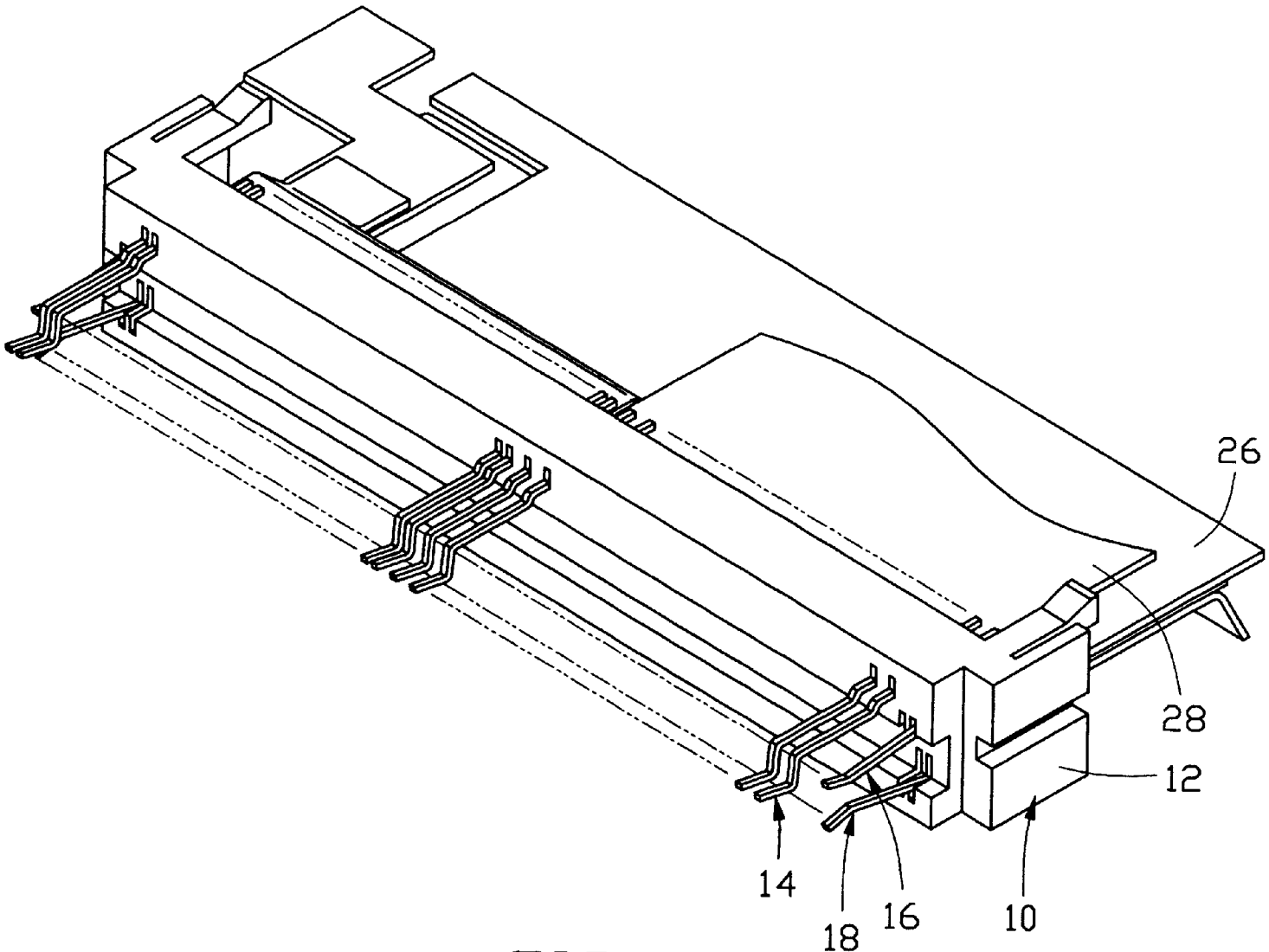
FIG. 5 is a perspective view of the power connector of FIG. 1 with a capacitor board and a flexible circuit board connected thereto.

As shown in FIGS. 1, 2 and 5, the first row 14 of contacts is located above the second row 16. The contacts 36, 38 of the first row 14 extend over the second contacts 16 and form concave portions 40 engageable with conductive pads 42 of the circuit board 24 thereby forming electrical engagement therebetween.

To this point, it is can be understood that four types of contacts 36, 38, 16, 18 are retained in a single insulative housing 12 in accordance with the present invention. The contacts 36, 38 are of different pitches. The second and third contacts 16, 18 may also be of different pitch from that of the contacts 36, 38 of the first row 14. Thus, a combination of contacts of different purposes and different pitches can then be integrated and retained in a single insulation housing. This saves substantial costs in manufacturing.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A power connector adapted to directly connect a central processing unit module to a power supply comprising:

a single insulation member;

two rows of contacts retained in the insulation member and opposing each other defining a nip area therebetween adapted to receive and retain a circuit board of the central processing unit module with the contacts mechanically and electrically engaging conductive pads formed on opposite surfaces of the circuit board; and an additional row of contacts retained in the insulation member and located above the two rows of contacts that form the nip area, the additional row of contacts being configured to engage additional conductive pads on the circuit board, the contacts of the additional row being divided into at least first and second groups having different pitches;

wherein the two rows of contacts that form the nip area are respectively contacts that transmit power to the central processing unit module and contacts that ground the central processing unit module;

wherein contacts of the two rows that form the nip are have concave portions opposing each other for defining the nip area that securely retains the circuit board to the connector;

wherein the first group of contacts transmit I/O signals and the second group of contacts transmit power to cache memory of the central processing unit module;

wherein the two rows of contacts that form the nip area project beyond the insulation member for connecting to a capacitor board;

wherein the contacts of the first group of the additional row extend beyond the insulation member for connecting to a flexible circuit board for signal transmission.

* * * * *